US010297202B2

(12) United States Patent
Xiang et al.

(10) Patent No.: US 10,297,202 B2
(45) Date of Patent: May 21, 2019

(54) ORGANIC LIGHT-EMITTING DISPLAY PANEL, DRIVING METHOD THEREOF, AND ORGANIC LIGHT-EMITTING DISPLAY DEVICE

(71) Applicants: Shanghai Tianma AM-OLED Co., Ltd., Shanghai (CN); Tianma Micro-Electronics Co., Ltd., Shenzhen (CN)

(72) Inventors: Dongxu Xiang, Shanghai (CN); Yue Li, Shanghai (CN); Tong Wu, Shanghai (CN); Dong Qian, Shanghai (CN); Gang Liu, Shanghai (CN); Zeyuan Chen, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 22 days.

(21) Appl. No.: 15/587,514

(22) Filed: May 5, 2017

(65) Prior Publication Data

US 2017/0243542 A1 Aug. 24, 2017

(30) Foreign Application Priority Data

Dec. 21, 2016 (CN) ..... 2016 1 1188761

(51) Int. Cl.
*G09G 3/30* (2006.01)
*G09G 3/32* (2016.01)
(Continued)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC .. G09G 3/3258; G09G 3/3291; G09G 3/3266; G09G 2300/0819
See application file for complete search history.

(56) References Cited

U.S. PATENT DOCUMENTS 9,424,782 B2 * 8/2016 Park ..... G09G 3/3291
2015/0187281 A1 * 7/2015 Lee ..... G09G 3/3258 345/212
2015/0243203 A1 8/2015 Kim et al.

FOREIGN PATENT DOCUMENTS

CN 103295524 A 9/2013
CN 105761677 A 7/2016
(Continued)

*Primary Examiner* — Xuemei Zheng
(74) *Attorney, Agent, or Firm* — Anova Law Group, PLLC

(57) ABSTRACT

An organic light-emitting display panel, a driving method thereof, and an organic light-emitting display device are provided. The organic light-emitting display panel includes a pixel driving circuit comprising an organic light-emitting element, a driving module, an initialization module, a data write-in module, and a light-emitting control module. The driving module includes a control end, a first end and a second end. The light-emitting control module is configured to transmit a signal to the second end of the driving module. The driving module is configured to drive the organic light-emitting element to emit light based on the signal transmitted by the light-emitting control module. The initialization module is configured to initialize a voltage level of the control end and a voltage level of the first end of the driving module. The data write-in module is configured to write a data signal into the control end of the driving module.

20 Claims, 9 Drawing Sheets

(51) Int. Cl.
*G09G 3/3258* (2016.01)
*G09G 3/3266* (2016.01)
*G09G 3/3291* (2016.01)

(52) U.S. Cl.
CPC ..... *G09G 2300/0809* (2013.01); *G09G 2300/0819* (2013.01)

(56) References Cited

FOREIGN PATENT DOCUMENTS

| | | | |
|---|---|---|---|
| CN | 105810151 | A | 7/2016 |
| CN | 205541822 | U | 8/2016 |
| CN | 106023895 | A | 10/2016 |
| CN | 106128365 | A | 11/2016 |
| WO | 2016161866 | A1 | 10/2016 |

* cited by examiner

ORGANIC LIGHT-EMITTING DISPLAY PANEL, DRIVING METHOD THEREOF, AND ORGANIC LIGHT-EMITTING DISPLAY DEVICE

CROSS-REFERENCE TO RELATED APPLICATIONS

This application claims priority of Chinese Patent Application No. 201611188761.X, filed on Dec. 21, 2016, the entire contents of which are hereby incorporated by reference.

FIELD OF THE DISCLOSURE

The present disclosure generally relates to the field of display technology and, more particularly, relates to an organic light-emitting display panel, a driving method thereof, and an organic light-emitting display device.

BACKGROUND

An organic light-emitting display utilizes the self-luminous property of an organic semiconductor material for display. Different from the liquid crystal display, the organic light-emitting display needs no backlight, thereby effectively reducing the thickness of the display screen. Often, a pixel array comprising a plurality of sub-pixels is disposed in a display region of the organic light-emitting display. Each sub-pixel includes an organic light-emitting diode that is driven by a pixel driving circuit to emit light.

An existing pixel driving circuit may include a driving transistor, and the driving transistor may provide a light-emitting current to the organic light-emitting diode under control of the light-emitting control signal. Often, the light-emitting current of the organic light-emitting diode is related to the threshold voltage Vth of the driving transistor.

However, the threshold voltage Vth of the driving transistor may drift (i.e., threshold drift) because of reasons such as fabrication process and aging after long-time use. Accordingly, the accuracy of tight-emitting brightness of the organic light-emitting diode is relatively poor. The drift amounts of the threshold voltages of different organic light-emitting diodes may be different from each other, and the display brightness of each sub-pixel may differ greatly from each other. Thus, the display evenness of the images can be relatively poor.

The disclosed organic light-emitting display panel, driving method thereof, and organic light-emitting display device are directed to solving at least partial problems set forth above and other problems.

BRIEF SUMMARY OF THE DISCLOSURE

One aspect of the present disclosure provides an organic light-emitting display panel. The organic light-emitting display panel includes a pixel driving circuit comprising an organic light-emitting element, a driving module, an initialization module, a data write-in module, and a light-emitting control module. The driving module includes a control end, a first end and a second end. The light-emitting control module is configured to transmit a signal to the second end of the driving module. The driving module is configured to drive the organic light-emitting element to emit light based on the signal transmitted by the light-emitting control module. The initialization module is configured to initialize a voltage level of the control end and a voltage level of the first end of the driving module. The data write-in module is configured to write a data signal into the control end of the driving module.

Another aspect of the present disclosure provides a driving method of an organic light-emitting display panel. The organic light-emitting display panel, includes a pixel driving circuit comprising a driving transistor, an initialization module connected to a first scanning signal end, a data write-in module connected to a second scanning signal end, a light-emitting control module connected to a light-emitting signal end, a data write-in module connected to a data signal end, and a first voltage end. The driving method comprises, in a first stage, supplying a first voltage level signal to the first scanning signal end and the light-emitting signal end, thereby initializing, by the initialization module, a control end and a first end of the driving module to a same voltage level; in a second stage, supplying the first voltage level signal to the second scanning signal end and the light-emitting signal end, supplying the second voltage level signal to the first scanning signal end, and supplying a first signal to the data signal end, thereby writing the first signal, by the data write-in module to the control end of the driving module, and charging, by the first voltage end, the first end of the driving module. The driving method further comprises: in a third stage, supplying the second voltage level signal to the light-emitting signal end, and supplying the data signal to the data signal end, thereby raising or lowing the voltage level of the control end of the driving module; and in a fourth stage, supplying the first voltage level signal to the light-emitting signal end and supplying the second voltage level signal to the first scanning signal end and the second scanning signal end, such that an organic light-emitting element emits light based on a voltage difference between the first end and the control end of the driving module.

Another aspect of the present disclosure provides organic light-emitting display device. The organic light-emitting display device includes a light-emitting display panel comprising a pixel driving circuit. The pixel driving circuit comprises an organic light-emitting element, a driving module, an initialization module, a data write-in module, and a light-emitting control module. The driving module includes a control end, a first end and a second end. The light-emitting control module is configured to transmit a signal to the second end of the driving module. The driving module is configured to drive the organic light-emitting element to emit light based on the signal transmitted by the light-emitting control module. The initialization module is configured to initialize a voltage level of the control end and a voltage level of the first end of the driving module. The data write-in module is configured to write a data signal into the control end of the driving module.

Other aspects of the present disclosure can be understood by those skilled in the art in light of the description, the claims, and the drawings, of the present disclosure.

BRIEF DESCRIPTION OF THE DRAWINGS

Other features, goals, and advantages of the present disclosure will become more apparent via a reading of detailed descriptions of non-limiting embodiments with reference to the accompanying drawings.

DETAILED DESCRIPTION

Reference will be made in detail with reference to embodiments of the present disclosure as illustrated in the accompanying drawings and embodiments. It should be understood that, specific embodiments described herein are only for illustrative purposes, and are not intended to limit the scope of the present disclosure. In addition, for ease of description, accompanying drawings only illustrate a part of, but not entire structure related to the present disclosure.

It should be noted that when there is no conflict, disclosed embodiments and features of the disclosed embodiments may be combined with each other. Hereinafter, the present disclosure is illustrated in detail with reference to embodiments thereof as illustrated in the accompanying drawings.

Figure 1:
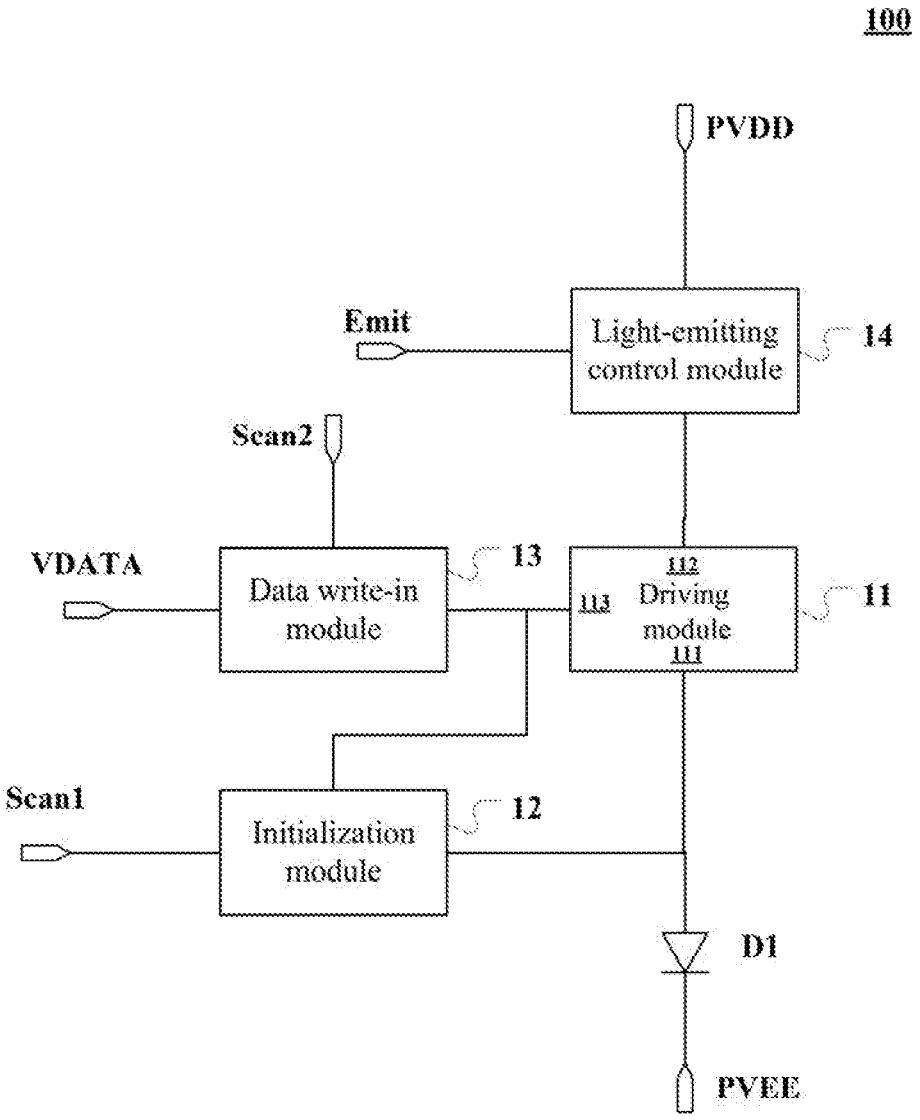
FIG. 1 illustrates an exemplary structural schematic view of a pixel driving circuit in an organic light-emitting display panel according to embodiments of the present disclosure.

FIG. 1 illustrates an exemplary structural schematic view of a pixel driving circuit 100 in an organic light-emitting display panel according to embodiments of the present disclosure. In one embodiment, for example, the organic light-emitting display panel may include a plurality of pixel driving circuits 100 arranged in an array.

Referring to FIG. 1, a pixel driving circuit 100 may include a driving module 11, an initialization module 12, a data write-in module 13, a light-emitting control module 14, and an organic light-emitting element D1. Optionally, the organic light-emitting element D1 may be an organic light-emitting diode, and the organic light-emitting diode may be denoted by the circuit symbol shown in FIG. 1.

The pixel driving circuit 100 may further include a first scanning signal end Scan1, a second scanning signal end Scan2, a light-emitting signal end Emit, and a data signal end VDATA. Optionally, the pixel driving circuit 100 may further include a first voltage end PVDD, and a second voltage end PVEE.

More specifically, the driving module 11 may include a first end 111, a second end 112, and a control end 113. The first end 111 of the driving module 11 may be electrically connected to a first electrode of the organic light-emitting element D1, and the second end 112 of the driving module 11 may be electrically connected to the light-emitting control module 14. Further, the driving module 11 may be configured to drive the organic light-emitting element D1 to emit light based on a signal supplied by the light-emitting control module 14 under control of the control end 113.

The light-emitting control module 14 may be electrically connected to the light-emitting signal end Emit, the first voltage end PVDD, and the driving module 11. The light-emitting control module 14 may be configured to transmit a signal outputted by the first voltage end PVDD to the driving module 11 under control of the light-emitting signal end Emit.

The initialization module 12 may be electrically connected to the first scanning signal end Scan1 and the driving module 11. Under control of the first scanning signal end Scan1, the initialization module 12 may be configured to initialize the voltage level of the control end 113 of the driving module 11 and the voltage level of the first end 111 of the driving module 11.

The data write-in module 13 may be electrically connected to the second scanning signal end Scan2, the data signal end VDATA, and the control end 113 of the driving module 11. Under control of the second scanning signal end Scan2, the data write-in module 13 may be configured to write a signal outputted by the data signal end VDATA into the control end 113 of the driving module 11.

Further, a second electrode of the organic light-emitting element D1 may be electrically connected to the second voltage end PVEE. Optionally, the first voltage end PVDD may be configured to supply a constant voltage with a relatively large voltage level, and the second voltage end PVEE may be configured to supply a constant voltage with a relatively small voltage level. That is, the constant voltage supplied by the first voltage end PVDD may be greater than the constant voltage supplied by the second voltage end PVEE.

As mentioned above, in the pixel driving circuit 100, the initialization module 12 may be configured to initialize the voltage level of the control end 113 of the driving module 11 and the voltage level of the first end 111 of the driving module 11 under control of the first scanning signal end Scan1. That is, the initialization module 12 may be configured to simultaneously initialize the voltage levels of the control end 113 and the first end 111 of the driving module 11. Optionally, the initialization module 12 may be configured to initialize the control end 113 and the first end 11 of the driving module 11 to the same voltage level.

Further, the driving module 11 may be turned on or off under control of the voltage difference between the control end 113 and the first end 111 of the driving module 11. The light-emitting control module 14 may be electrically connected to the second end 112 of the driving module 11. When the light-emitting control module 14 and the driving module 11 are turned on, the first voltage end PVDD may be configured to charge the first end 111 of the driving module 11 until the voltage difference between the control end 113 and first end 111 of the driving module 11 reaches a cut-off value.

At the moment when the driving module 11 is turned off, the voltage difference between the control end 113 and the first end 111 of the driving module 11 may be referred to as the threshold voltage. Accordingly, by using the disclosed pixel driving circuit the threshold voltage of the driving module 11 may be detected and further, the threshold voltage of the driving module 11 may be compensated. Thus, the impact of the threshold drift on the display brightness may be avoided, thereby improving the display effect of the organic light-emitting display panel.

Figure 2:
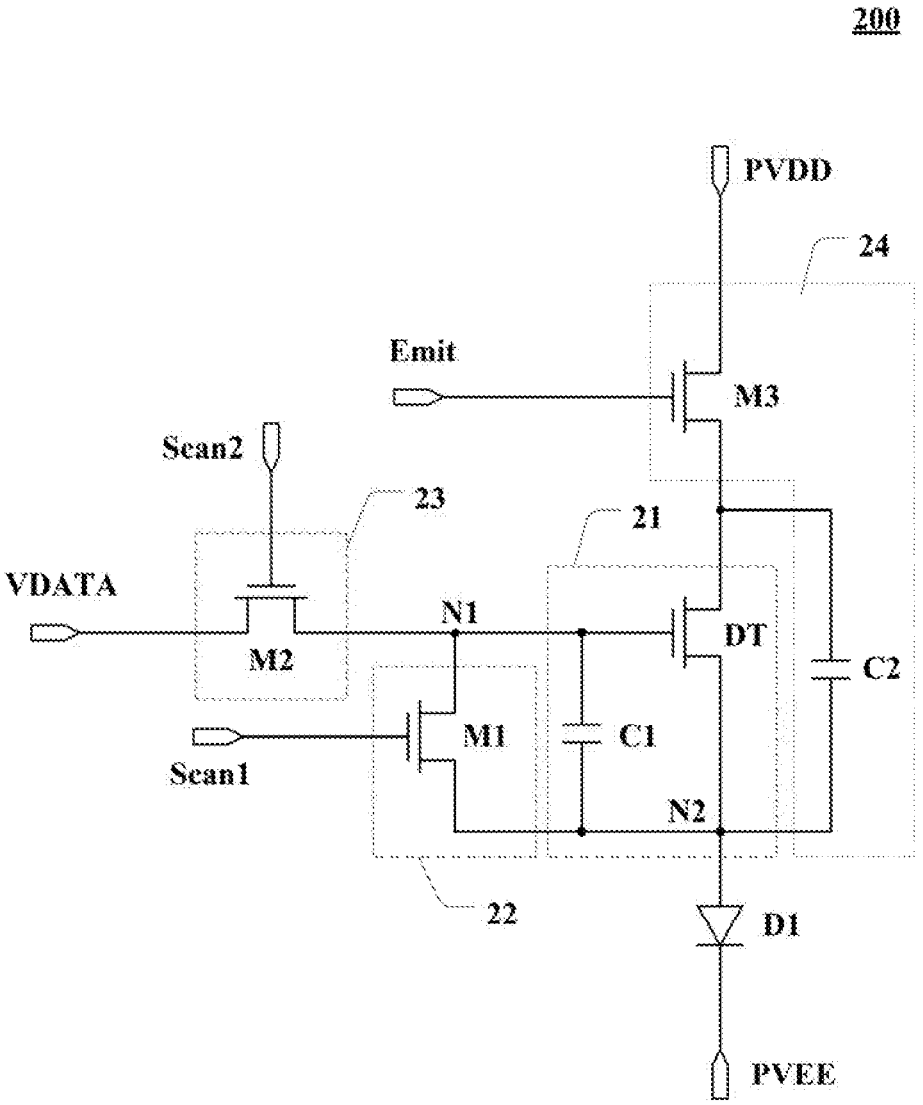
FIG. 2 illustrates an exemplary specific structural schematic view of a pixel driving circuit in FIG. 1.

Further, the aforementioned pixel driving circuit 100 may have various different circuit structures. FIG. 2 illustrates an exemplary specific structural schematic view of a pixel driving circuit in FIG. 1. As shown in FIG. 2, a pixel driving circuit 200 may include a driving module 21, an initialization module 22, a data write-in module 23, and a light-emitting control module 24. The driving module 21, the initialization module 22, the data write-in module 23, and the light-emitting control module 24 in FIG. 2 may correspond to the driving module 11, the initialization module 12, the data write-in module 13, and the light-emitting control module 14 in FIG. 1, respectively.

More specifically, the driving module 21 may include a driving transistor DT and a first capacitor C1. A control end (e.g., gate electrode) of the driving transistor DT may correspond to the control end (the node N1 shown in FIG. 2) of the driving module 21. A first electrode and a second electrode of the driving transistor DT may be the first end and the second end of the driving module 21, respectively.

Further, two plates of the first capacitor C1 may be electrically connected to the control end and the first electrode of the driving transistor DT, respectively. The first electrode (i.e., the node N2 shown in FIG. 2) of the driving transistor DT may be further electrically connected to the first electrode of the organic light-emitting element D1. Further, the first electrode of the organic light-emitting element D1 may be an anode, and a second electrode of the organic light-emitting element D1 may be a cathode.

The initialization module 22 may include a first transistor M1. A first electrode of the first transistor M1 may be electrically connected to the control end (the node N1) of the driving transistor DT, and a second electrode of the first transistor M1 may be electrically connected to the first electrode of the driving transistor DT. Further, a gate electrode of the first transistor M1 may be electrically connected to the first scanning signal end Scan1.

The data write-in module 23 may include a second transistor M2. A gate electrode of the second transistor M2 may be electrically connected to the second scanning signal end Scan2, a first electrode of the second transistor M2 may be electrically connected to the data signal end VDATA, and a second electrode of the second transistor M2 may be electrically connected to the control end of the driving transistor DT.

The light-emitting control module 24 may include a third transistor M3 and a second capacitor C2. A gate electrode of the third transistor M3 may be electrically connected to the light-emitting signal end Emit. A first electrode of the third transistor M3 may be electrically connected to the first voltage end PVDD, and a second electrode of the transistor M3 may be electrically connected to the second electrode of the driving transistor DT. Two palates of the second capacitor C2 may be electrically connected to the first electrode and the second electrode of the driving transistor DT, respectively.

Because the control end and the first electrode of the driving transistor DT are electrically connected to the first electrode and the second electrode of the first transistor M1, respectively, when the first transistor M1 is turned on, the voltage level of the control end of the driving transistor DT may be equal to the voltage level of the first electrode of the driving transistor DT. Further, the control end and the first electrode of driving transistor DT may be electrically connected to the two plates of the first capacitor C1, respectively. Accordingly, when the first transistor M1 is turned off, the first capacitor C1 may be configured to maintain the voltage difference between the control end and the first electrode of the driving transistor DT.

Thus, when the first voltage end PVDD charges the first electrode of the driving transistor till the difference in the voltage levels between the control end and the first end of the driving transistor DT is equal to the threshold voltage, the driving transistor may change from an ON status to an OFF status. By then, the first capacitor C1 may be configured to maintain the difference in the voltage levels between the control end and the first end of the driving transistor DT to be equal to the threshold voltage Vth of the driving transistor DT.

The first capacitor C1 may also be configured as a coupling capacitor. When the data signal end VDATA charges she control end of the driving transistor DT via the data write-in module 23, if the first electrode of the driving transistor DT is floated, the first capacitor C1 may generate electric charges at the first electrode of the driving transistor DT via coupling. Thus, the voltage level of the first electrode of the driving transistor DT may vary as the voltage level of the control end of the driving transistor DT varies.

At such moment, the voltage difference Vgs between the control end and the first electrode of the driving transistor DT may be equal to A+Vth (i.e., Vgs=A+Vth), where A is a parameter related to the voltage level of the signal inputted by the data signal end but not related to the threshold voltage Vth of the driving transistor DT. The parameter A may be illustrated more specifically in descriptions of a driving method hereinafter with reference to an operational sequence diagram of the disclosed pixel driving circuit.

Further, the light-emitting current Ids of the organic light-emitting element D1 and the voltage level of the driving transistor DT may have the following relationship: $Ids=K\times(Vgs-Vth)^2=K\times A^2$, where K is a coefficient related to the channel width-to-length ratio of the driving transistor DT. Accordingly, the light-emitting current Ids of the light-emitting element D1 may be unrelated to the threshold voltage Vth of the driving transistor DT.

That is, the aforementioned pixel driving circuit may implement the compensation of the threshold voltage Vth of driving transistor DT, such that the light-emitting brightness of the organic light-emitting element D1 may be unrelated to the threshold voltage Vth of the driving transistor DT. Further, the display brightness of each sub-pixel may be relatively accurate during display. Accordingly, the evenness of the display brightness of the display panel may be improved, thereby facilitating the display effect.

Further, in the aforementioned pixel driving circuit 200, the voltage level of the first electrode of the first transistor M1 in the initialization module 22 may be supplied by the second transistor M2. Because the first electrode of the second transistor M2 is electrically connected to the data signal end VDATA, the disclosed pixel driving, circuit 200 may utilize the data signal end VDATA to initialize the voltage levels of the control end and the first electrode of the driving transistor DT.

Thus, no initialization signal line is needed, and the number of signal lines in the organic light-emitting display panel comprising the pixel driving circuit 200 may be reduced. Accordingly, the area of the evaporable organic light-emitting material may be increased, and the aperture ratio and the resolution of the organic light-emitting display panel may be further improved.

Figure 3:
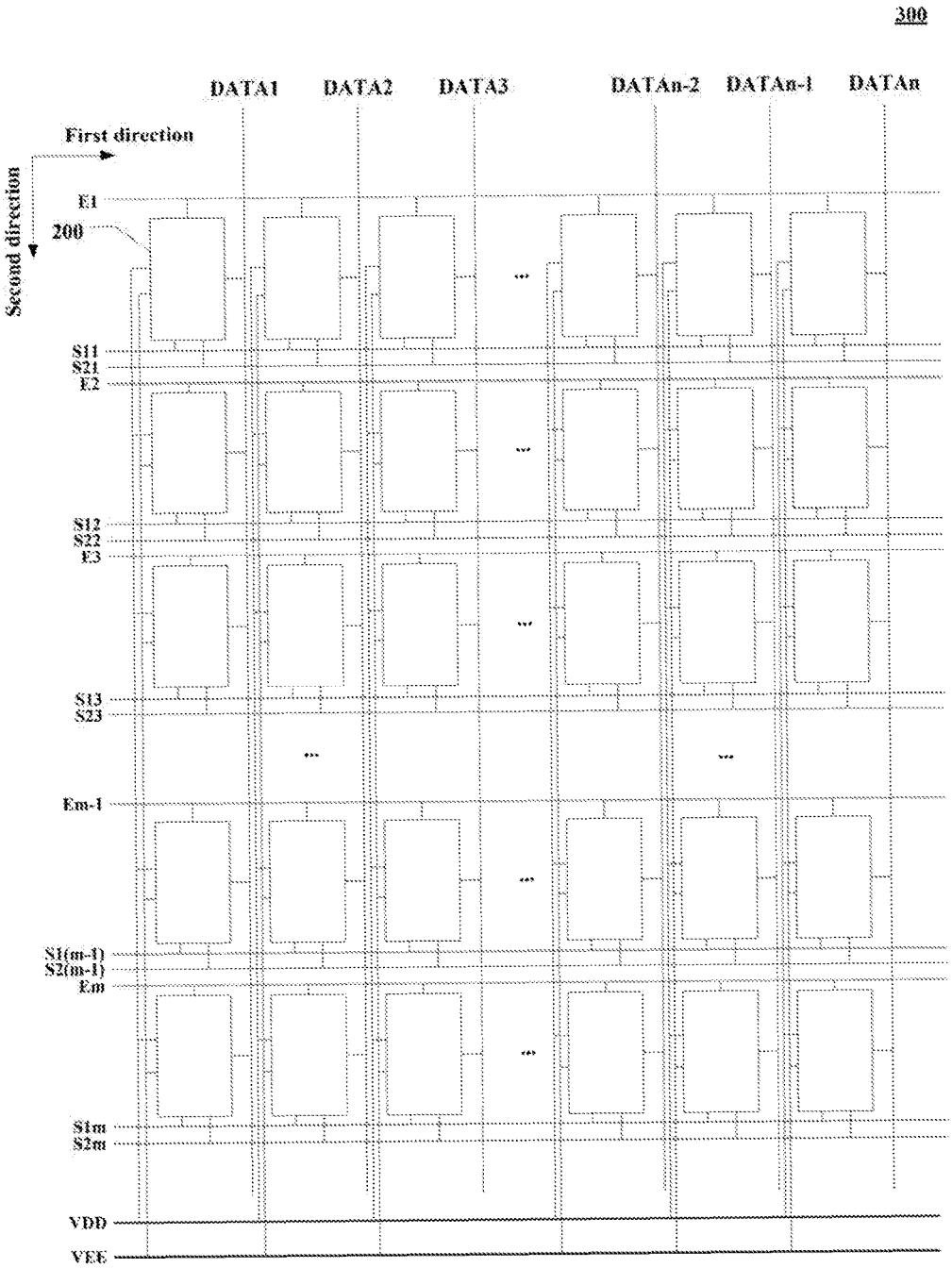
FIG. 3 illustrates an exemplary structural schematic view of an organic light-emitting display panel including a pixel driving circuit illustrated in FIG. 2.

FIG. 3 illustrates an exemplary structural schematic view of an organic light-emitting display panel 300 including a pixel driving circuit 200 illustrated in FIG. 2. As shown in FIG. 3, the organic light-emitting display panel 300 may include a plurality of pixel driving circuits 200 arranged in a matrix array. For example, the organic light-emitting display panel 300 may include a plurality of pixel driving circuits 200 arranged along a first direction and a second direction into a matrix array. The first direction may be a row direction of the matrix array, and the second direction may be a column direction of the matrix array. Further, the pixel driving circuit 200 may have a circuit structure illustrated in FIG. 2, and the related descriptions are not described here in detail.

Further, as shown in FIG. 3, the organic light-emitting display panel 300 may further include a plurality of first scanning signal lines S11, S12, S13, . . . , S1($m$−1), and S1$m$, and a plurality of second scanning-signal lines S21, S22, S23, . . . , S2($m$−1) and S2$m$, where m is a positive integer greater than 1. The organic light-emitting display panel may further include a plurality of light-emitting signal lines E1, E2, E3 . . . , Em−1, Em, and a plurality of data lines DATA1, DATA2, DATA3, . . . , DATAn−1, DATAn, where n is a positive integer greater than 1. Further, the organic light-emitting display panel may include a first voltage signal line VDD and a second voltage signal line VEE.

In one embodiment, the plurality of first scanning signal lines S11, S12, S13, . . . , S1($m$−1), and S1$m$ may be arranged along the second direction and extending along the first direction. The plurality of second scanning signal lines S21, S22, S23, . . . , S2($m$−1), and S2$m$ may be arranged along the second direction and extending along the first direction.

The plurality of light-emitting signal line E1, E2, E3, . . . , Em−1, Em may be arranged along the second direction and extending along the first direction. The plurality of data lines DATA1, DATA2, DATA3, . . . , DATAn−1, DATAn may be arranged along the first direction and extending along the second direction. The first voltage signal, line VDD and the second voltage signal line VEE may extend along the first direction.

Further, each of the plurality of the first scanning signal, lines S11, S12, S13, . . . , S1($m$−1), and S1$m$ may be electrically connected to a plurality of first scanning signal ends Scan1 in a same row of pixel driving circuits 200. Each of the plurality of the second scanning signal line S21, S22, . . . , S2($m$−1), and S2$m$ may be electrically connected to a plurality of second scanning signal ends Scan2 in a same row of pixel driving circuits 200.

Further, each of the plurality of light-emitting signal line E1, E2, E3, . . . , Em−1, and Em may be electrically connected to a plurality of light-emitting signal ends Emit in a same row of pixel driving circuits 200. Each of the plurality of data line DATA1, DATA2, DATA3, . . . , DATAn−1, and DATAn may be electrically connected to a plurality of data signal ends VDATA in a same column of pixel driving circuits. Further, the first voltage end PVDD of each pixel driving circuit 200 may be electrically connected to the first voltage signal line VDD, and the second voltage end PVEE of each pixel driving circuit 200 may be electrically connected to the second voltage signal line VEE.

By using the structure illustrated in FIG. 3, each row of pixel driving circuits 200 in the disclosed organic light-emitting display panel 300 may be connected to a same first scanning line, a same second scanning line, and a same light-emitting signal line. Further, each column of pixel driving circuits 200 may be connected to a same data signal line. Accordingly, when the organic light-emitting display panel is driven to perform display, a corresponding first scanning driving signal may be supplied to the plurality of first scanning signal lines sequentially, and a corresponding second scanning driving signal may be supplied to the plurality of second scanning signal lines sequentially. Further, a corresponding light-emitting control signal may be supplied to the plurality of light-emitting signal lines sequentially.

Thus, organic light-emitting elements in each row of pixel driving circuits 200 may be turned on (e.g., to emit light) row by row. When organic light-emitting elements in a row of pixel driving circuits 200 are turned on, each data signal line may transmit a corresponding signal to the row of pixel, driving circuits 200. At such moment, each transistor in the rest rows of pixel driving circuits 200 may be turned off, and the signal carried by each data signal line may not be transmitted to the rest rows of pixel driving circuits 200. Accordingly, the driving of the display of the display panel may be implemented.

Figure 4:
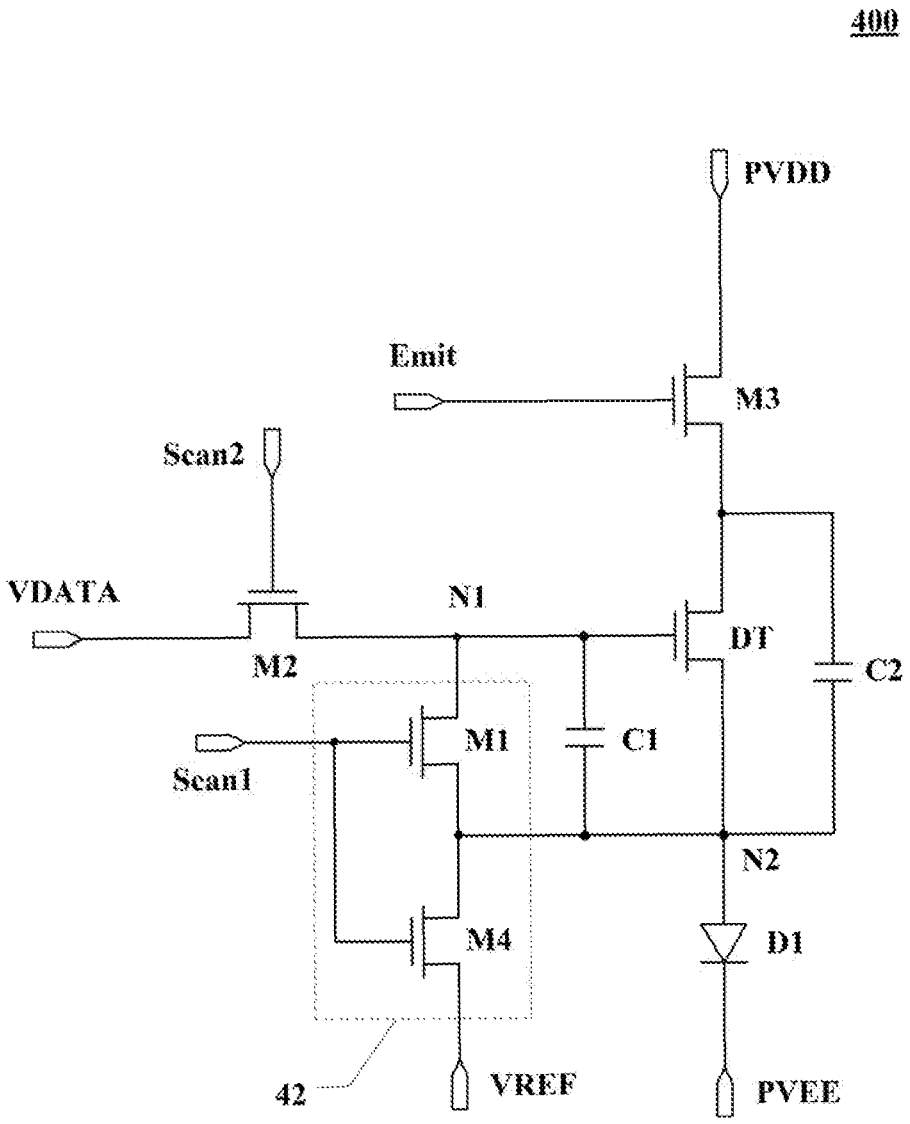
FIG. 4 illustrates another exemplary specific structural schematic view of a pixel driving circuit in FIG. 1.

FIG. 4 illustrates another exemplary specific structural schematic view of a pixel driving circuit in FIG. 1. As shown in FIG. 4, based on the pixel driving circuit 200 illustrated in FIG. 2, a pixel driving circuit 400 may further include a reference voltage signal end VREF. Other than the first transistor M1, an initialization module 42 may further include a fourth transistor M4. A gate electrode of the fourth transistor M4 may be electrically connected to the first scanning signal end Scan1, a first electrode of the fourth transistor M4 may be electrically connected to the reference voltage signal end VREF, and a second electrode of the fourth transistor M4 may be electrically connected to the first electrode of the driving transistor DT.

Further, because the gate electrode of the first transistor M1 and the gate electrode of the fourth transistor M4 are both electrically connected to the first scanning signal end Scan1, the first transistor M1 and the fourth transistor M4 may be simultaneously turned on or turned off. Further, the voltage level of the control end and the voltage level of the first electrode of the driving transistor DT may be supplied by the reference voltage signal end VREF. That is, when initializing the circuit, the first transistor M1 and the fourth transistor M4 may be controlled to be turned on, thereby transmitting a signal outputted by the reference voltage signal end VREF to the control end and the first electrode of the driving transistor DT.

Different from the circuit in FIG. 2, the circuit in FIG. 4 introduces the reference voltage signal end VREF. By adding the reference voltage signal end VREF, the data signal end VDATA may no longer need to be configured to supply an initialization signal to the driving transistor DT, thereby reducing the number of transitions in the voltage level of the signal outputted by the data signal end VDATA.

Accordingly, the complexity of the signal outputted by the data signal end VDATA may be lowered. Further, because the signal outputted by the data signal end VDATA is supplied by a driving integrated circuit (IC), by using the disclosed pixel driving circuit, the load of the driving IC may be reduced.

Further, the present disclosure also provides an organic light-emitting display panel including a pixel driving circuit 400 illustrated in FIG. 4. Based on the organic light-emitting display panel shown in FIG. 3, the organic light-emitting display panel may further include at least one reference voltage signal line. Each of the at least one reference voltage signal line may be electrically connected to reference voltage signal ends VREF of at least two pixel driving circuits 400. Optionally, the at least, two pixel driving circuits 400 electrically connected to the same reference voltage signal line may be disposed in the same row, or in the same column, or in different rows and different columns.

Figure 5:
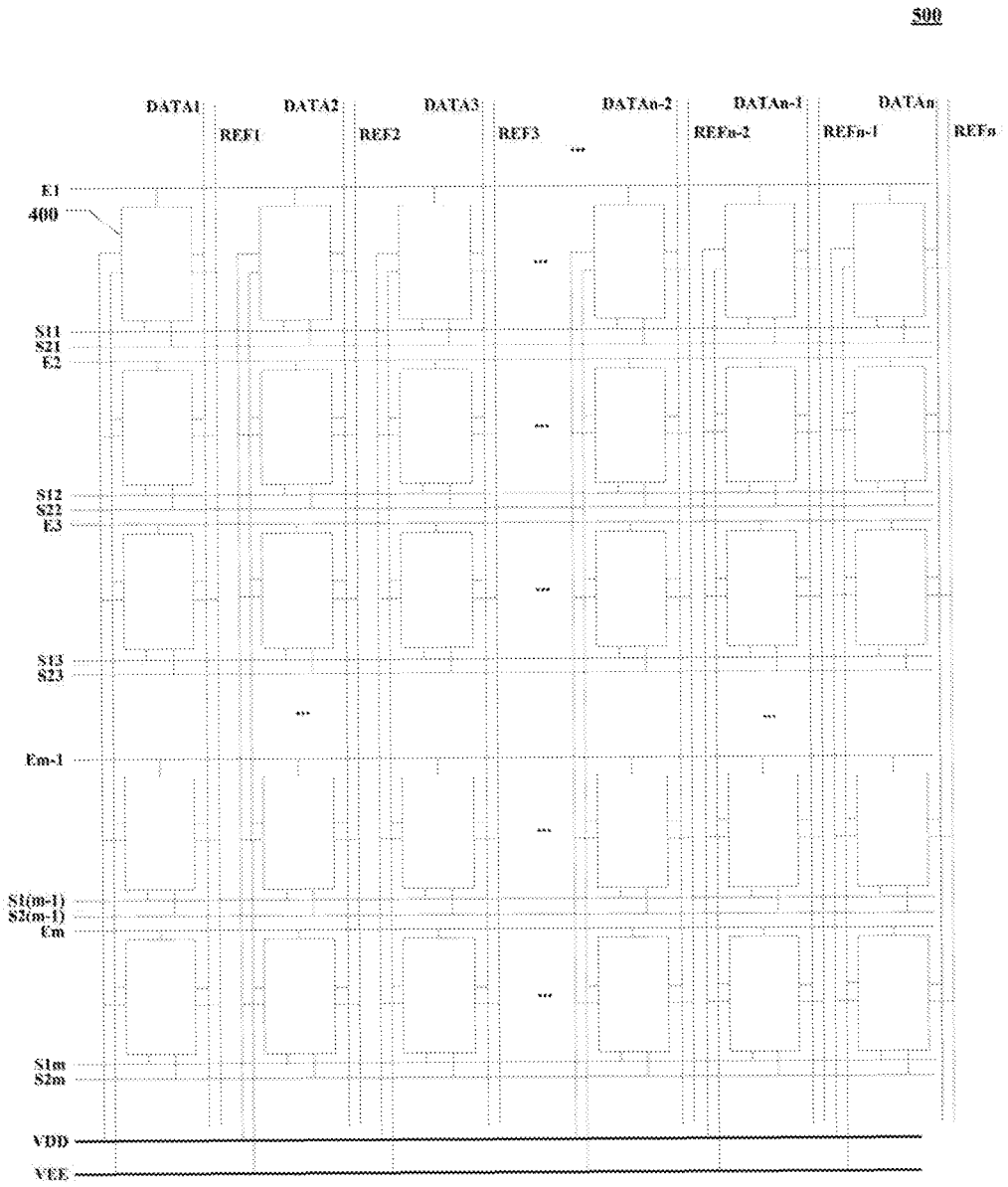
FIG. 5 illustrates an exemplary structural schematic-view of art organic light-emitting display panel including a pixel driving circuit illustrated in FIG. 4.

FIG. 5 illustrates an exemplary structural schematic view of an organic light-emitting display panel 500 including a pixel driving circuit 400 illustrated in FIG. 4. As shown in FIG. 5, based on the organic light-emitting display panel 300, the organic light-emitting display panel 500 may further include a plurality of reference voltage signal lines REF1, REF2, REF3, . . . , REFn−2, REFn−1, and REFn. Each of the plurality of reference voltage signal lines REF1, REF2, REF3, . . . , REFn−2, REFn−1 and REFn may be electrically connected to a plurality of reference voltage signal ends VREF in a same column of pixel driving circuits 400.

In some other embodiments, the reference voltage signal ends VREF in all pixel driving circuits 400 of the organic light-emitting display panel 500 may be connected to one reference voltage signal line. That is, optionally, only one reference voltage signal line may be needed in the organic light-emitting display panel 500. In other words, the voltage level of driving transistors in all pixel driving circuits 400 of the organic light-emitting display panel 500 may be initialized via the same reference voltage signal line.

In the organic light-emitting display panel 500 illustrated in FIG. 5, the voltage level of a driving transistor in the pixel driving circuit 400 may be initialized using a corresponding reference voltage signal line, and each data signal line may no longer need to transmit the initialization signal. Accordingly, the number of transitions in the voltage level of the signal carried by each data signal line may be reduced, and the stability of the signal transmitted by the data signal line may be improved.

Figure 6:
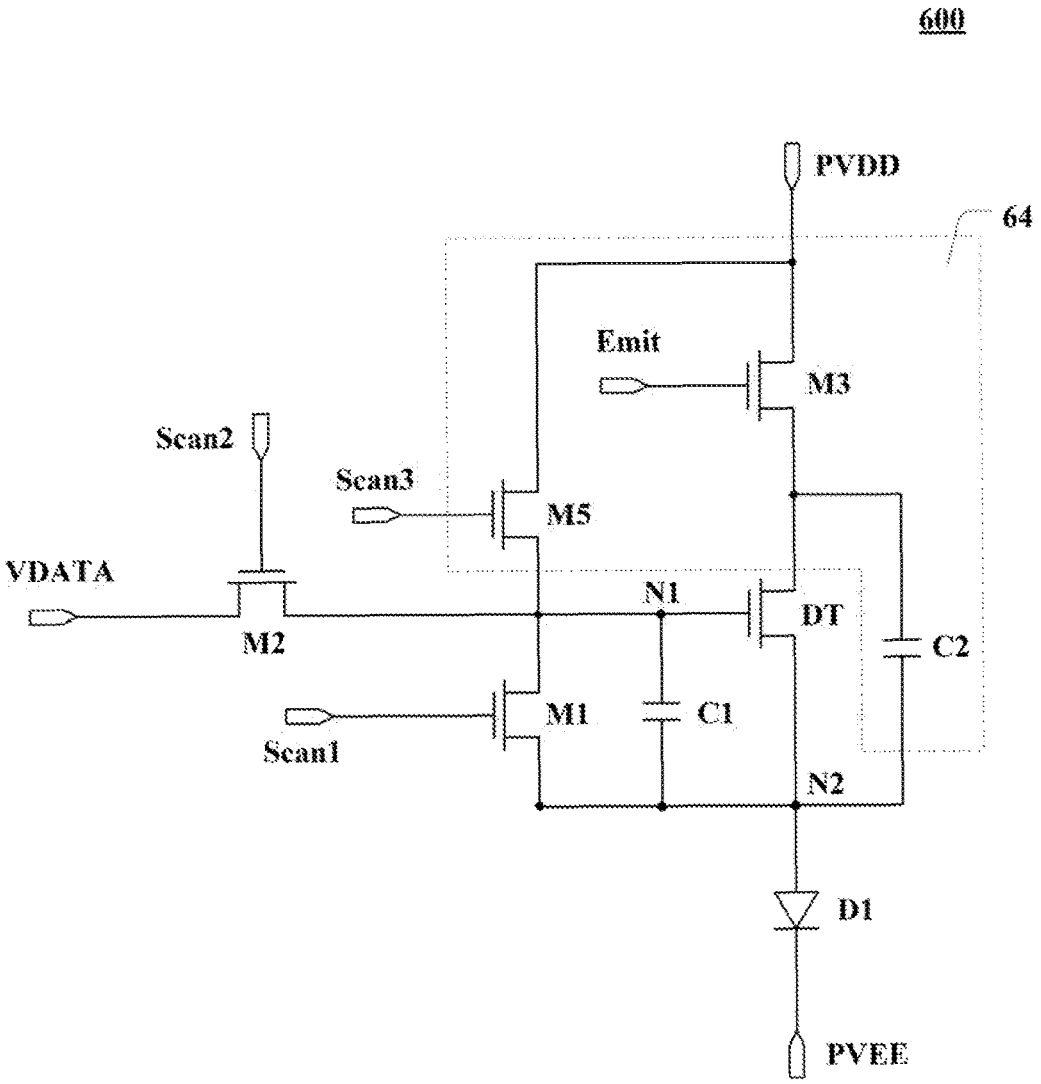
FIG. 6 illustrates another exemplary specific structural schematic view of a pixel driving circuit in FIG. 1.

FIG. 6 illustrates another exemplary specific structural schematic view of a pixel driving circuit in FIG. 1. As shown in FIG. 6, based on the pixel driving circuit 200 illustrated in FIG. 2, the pixel driving circuit 600 may further include a third scanning signal end Scan3, and a light-emitting control module 64 may further include a fifth transistor M5. A gate electrode of the fifth transistor M5 may be electrically connected to the third scanning signal end Scan3, a first electrode of the fifth transistor M5 may be electrically connected to the first voltage end PVDD, and a second electrode of the fifth transistor M5 may be electrically connected to the control end of the driving transistor DT.

Further, the light-emitting control module 64 may utilize the fifth transistor M5 to control and raise the voltage level of the control end of the driving transistor DT from a voltage level of the signal supplied by the data signal end VDATA to the voltage level of the signal supplied by the first voltage end PVDD. By then, under the effect of the first capacitor C1, the voltage level of the first electrode of the driving transistor DT may be increased correspondingly.

Accordingly, voltage level variance, in the signal supplied by the data signal end VDATA to control the variance in the voltage level of the control end and the voltage level of the first electrode of the driving transistor DT may no longer be needed. Thus, the number of transitions in the voltage level of the signal supplied by the data signal end VDATA may be further reduced. Optionally, in a working period of the pixel driving circuit 600, the data signal end VDATA may only need to supply data once, thereby effectively improving the stability of the signal ouputted by the data signal end.

Further, the present disclosure also provides an organic light-emitting display panel including the pixel driving circuit 600 illustrated in FIG. 6. Based on the organic light-emitting display panel shown in FIG. 3, the organic light-emitting display panel may further include a plurality of third scanning signal lines. Each of the plurality of third scanning signal lines may be electrically connected, to a plurality of third scanning signal ends in a same row of pixel driving circuits 600.

Figure 7:
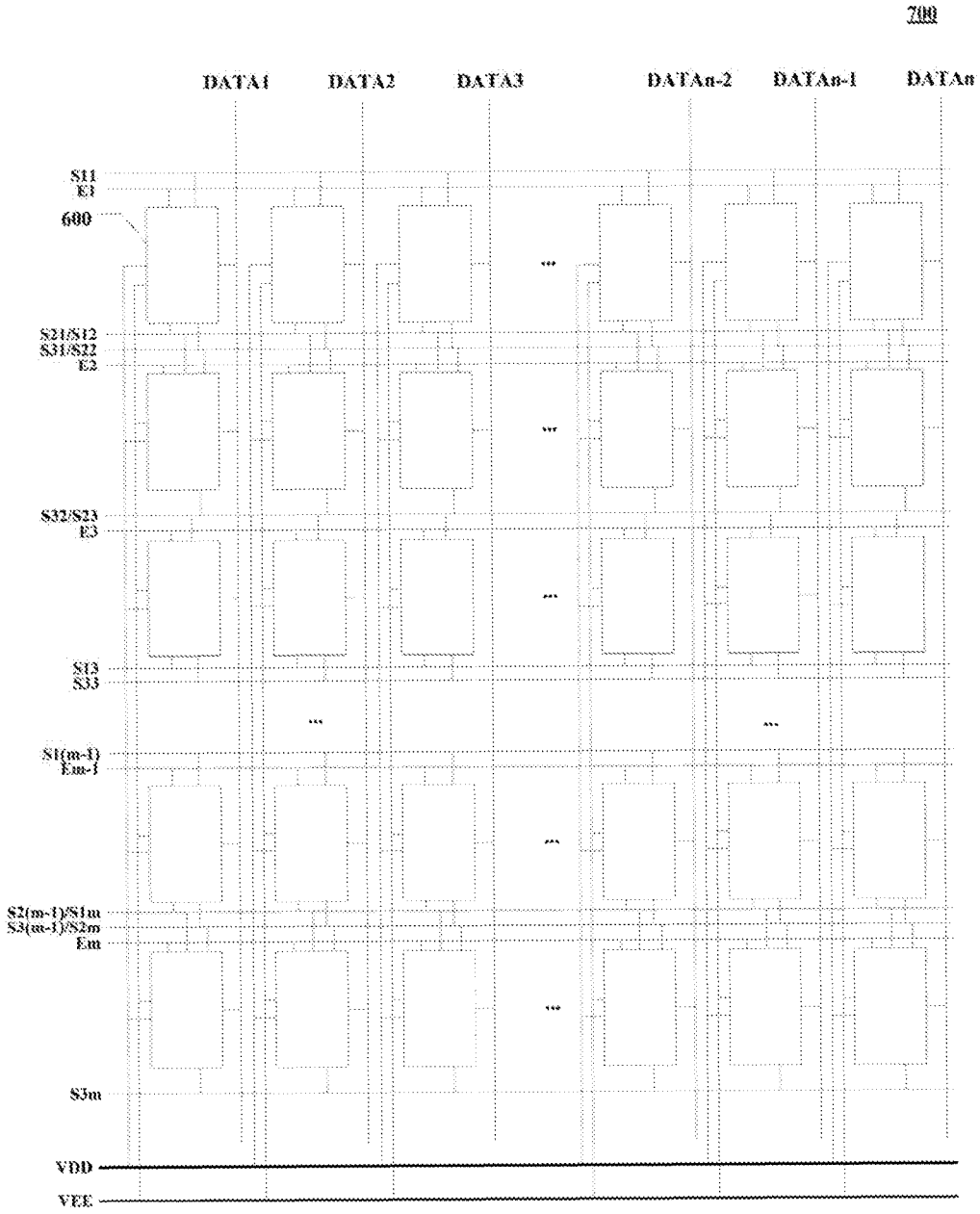
FIG. 7 illustrates an exemplary structural schematic view of an organic light-emitting display panel including a pixel driving circuit illustrated in FIG. 6.

FIG. 7 illustrates an exemplary structural schematic view of an organic light-emitting display panel 700 including a pixel driving circuit 600 illustrated in FIG. 6. As shown in FIG. 7, based on the organic light-emitting-display panel 300 illustrated in FIG. 3, the organic light-emitting display panel 700 may further include a plurality of third scanning, signal lines S31, S32, S33, . . . , S3($m$−1), and S3$m$. Each of the plurality of third scanning signal lines S31, S32, S33, . . . , S3($m$−1), and S3$m$ may be electrically connected to a plurality of third scanning signal ends Scan3 in a same row of pixel driving circuits 600.

Further, in some optional implementations of the organic light-emitting display panel 700 including the pixel driving circuit 600 in FIG. 6, a plurality of second scanning signal ends Scan2 in a row of pixel driving circuits 600 and a plurality of first scanning signal ends Scan1 in an adjacent row of pixel driving circuits 600 may be connected to a same first scanning signal line. Optionally, a plurality of third scanning signal ends Scan3 in a row of pixel driving circuits 600 and a plurality of second scanning signal ends Scan2 in air adjacent row of pixel driving circuits 600 may be connected to a same second scanning signal line.

For example, as shown in FIG. 7, a plurality of second scanning signal ends in a first row of pixel driving circuits 600 and a plurality of first scanning signal ends in a second row of pixel driving circuits 600 may be connected to a same first scanning signal line S12 (or S21). A plurality of third scanning signal ends in a first row of pixel driving circuits 600 and a plurality of second scanning signal ends in the second row of pixel driving circuits 600 may be connected to a same second scanning signal line S22 (or S31). A plurality of third scanning signal ends in the second row of pixel driving circuits 600 and a plurality of second scanning signal ends in the third row of pixel driving circuits 600 may be connected to a same second scanning signal line S23 (or S32).

That is, a plurality of second scanning signal ends in an $(m-1)^{th}$ row of pixel driving circuits 600 and a plurality of first scanning signal ends in an $m^{th}$ row of pixel driving circuits 600 may be connected to the first scanning signal line S1$m$ (or S2($m$−1)). A plurality of third scanning signal ends in the $(m-1)^{th}$ row of pixel driving circuits 600 and a plurality of second scanning signal ends in the $m^{th}$ row of pixel driving circuits 600 may be connected to the second scanning signal line S2$m$ (or S3($m$−1)).

As shown in FIG. 7, by configuring two adjacent rows of pixel driving circuits 600 in the disclosed organic light-emitting display panel 700 to share a same scanning signal line, the number of signal lines in the organic light-emitting display panel 700 may be reduced. Further, because the data signal line only needs to supply the data signal (i.e., data may only need to be supplied once when each pixel driving circuit operates), the stability of the signal carried by the data line may be improved, and the power consumption of the organic light-emitting display panel 700 may be reduced.

Optionally, the aforementioned first transistor M1, the second transistor M2, the third transistor M3, the fourth transistor M4, the fifth transistor M5, and the driving transistor DT may each be an N-type transistor, or a P-type transistor. When the driving transistor DT is an N-type transistor, the threshold voltage Vth of the driving transistor DT may be greater than 0 (i.e., Vth>0). When the driving transistor DT is a P-type transistor, the threshold voltage Vth of the driving transistor DT may be less than 0 (i.e., Vth<0).

The present disclosure also provides a driving method applicable to the aforementioned organic light-emitting display panel. The driving method may include, in a first stage, supplying a first voltage level signal to the first scanning signal end Scan1 and the light-emitting signal end Emit, and initializing, by the initialization module, the control end and the first end of the driving module to the same voltage level.

Further, the driving method may include, in a second stage, supplying the first voltage level signal to the second scanning signal end Scan2 and the light-emitting signal end Emit, supplying the second voltage level signal to the first scanning signal end Scan1, and supplying a first signal to the data signal end VDATA. Further, in the second stage, the data write-in module may be configured to write the first signal into the control end of the write-in driving module, and the first voltage end PVDD may be configured to charge the first end of the driving module.

The driving method may further include, in a third stage, supplying the second voltage level signal to the first scanning signal end Scan1 and the light-emitting signal end Emit, and supplying a data signal to the data signal end VDATA, such that the voltage level of the control end of the driving module may be raised or lowered. The driving method may further include, in a fourth stage, supplying the first voltage level signal to the light-emitting signal end Emit, and supplying the second voltage level signal to the first scanning signal end Scan1 and the second scanning signal end Scan2. Further, in the fourth stage, the organic light-emitting element may emit light based on a voltage level difference between the voltage level of the first end of the driving module and the voltage level of the control end of the driving module.

Further, the first transistor M1, the second transistor M2, the third transistor M3, the fourth transistor M4, the fifth transistor M5, and the driving transistor DT may be all assumed as N-type transistors hereinafter for illustrative purposes. The first voltage level signal in the aforementioned driving method may be assumed to be a high voltage level signal, and the second voltage level signal may be assumed to be a low voltage level signal.

Figure 8:
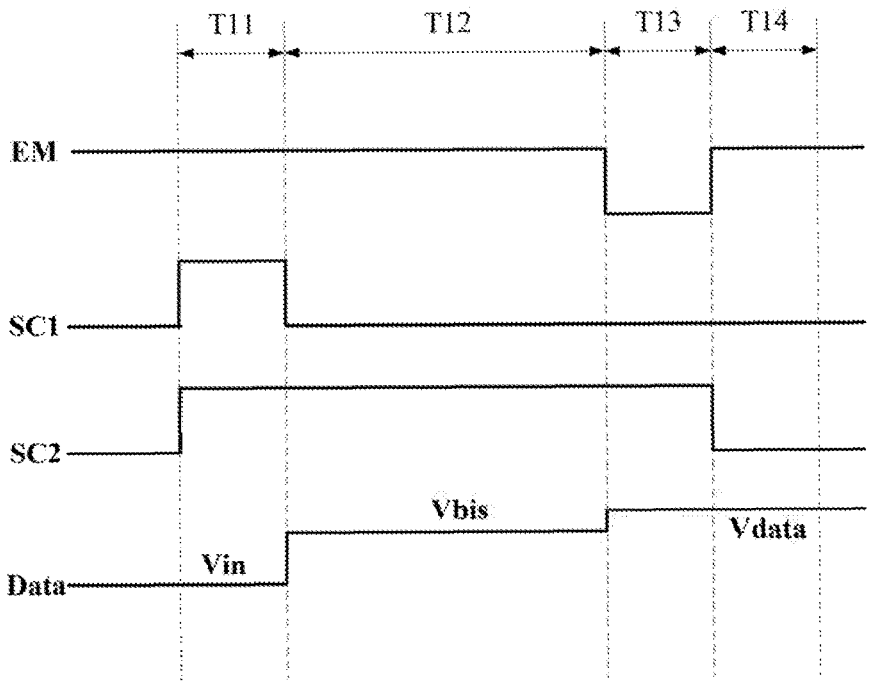
FIG. 8 illustrates an operational timing sequence of a pixel driving circuit in FIG. 2.
Figure 9:
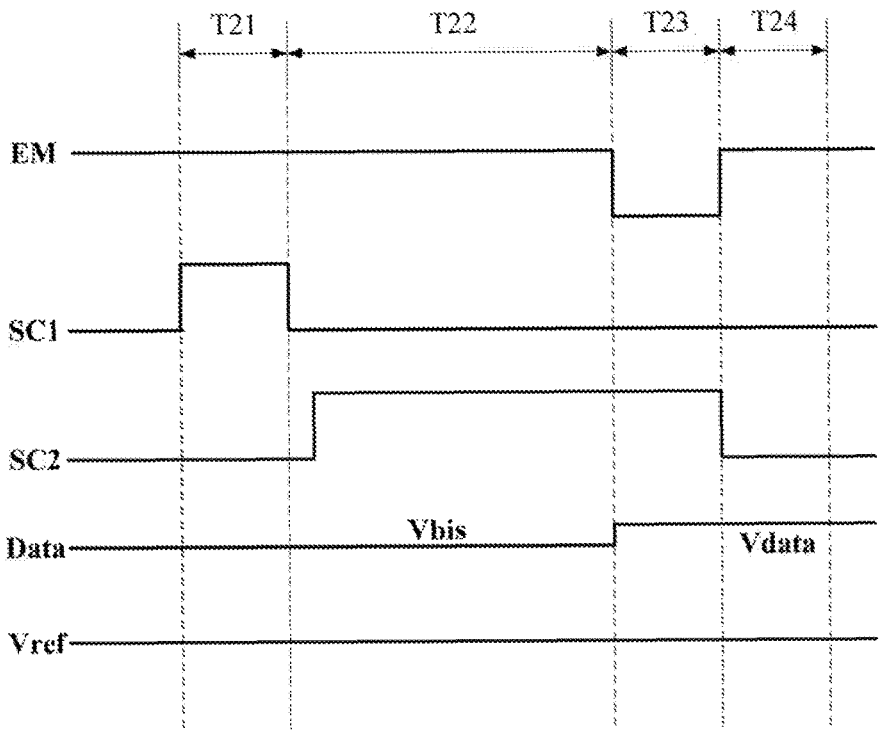
FIG. 9 illustrates an operational timing sequence of a pixel driving circuit in FIG. 4.
Figure 10:
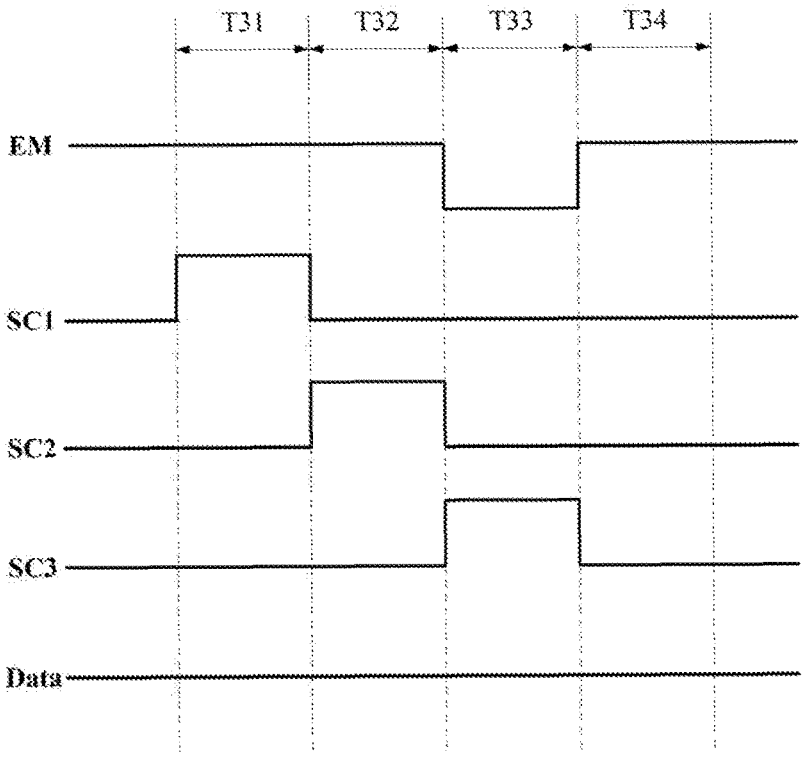
FIG. 10 illustrates an operational timing sequence of a pixel driving circuit in FIG. 6.

FIG. 8 illustrates an operational timing sequence of a pixel driving circuit 200 in FIG. 2. FIG. 9 illustrates an operational timing sequence of a pixel driving circuit 400 in FIG. 4. FIG. 10 illustrates an operational timing sequence of a pixel driving circuit 600 in FIG. 6. The working principles of the aforementioned driving method may be illustrated in detail with reference to FIG. 8~FIG. 10.

Referring to FIG. 8~FIG. 10, for example, SC1, SC2, SC3, EM, Data, Vref may represent signals supplied to the first scanning signal end Scan1, the second scanning signal end Scan2, the third scanning signal end Scan3, the light-emitting signal end Emit, the data signal end VDATA, and the reference voltage signal end VREF, respectively.

Further, the high voltage level and the low voltage level may represent a relative relationship of voltage levels, and may not particularly refer to a specific voltage level of the signals. For example, the high voltage level signal may be a signal that turns on the first to the fifth transistors (M1~M5), and the low voltage level signal may be a signal that turns off the first to the fifth transistors (M1~M5).

Referring to FIG. 8, an operational timing sequence is provided for a pixel driving circuit 200 in FIG. 2. The operational timing sequence in FIG. 8 may include a first stage T11, a second stage T12, a third stage T13, and a fourth stage T14. In the first stage T11, the first voltage level signal may be supplied to the first scanning signal end Scan1 and the light-emitting signal end Emit, thereby turning on the first transistor M1 and the third transistor M3. The first voltage level signal may be supplied to the second scanning signal end Scan1, thereby turning on the second transistor M2.

Further, an initialization voltage signal Vin may be supplied to the data signal end VDATA, the data write-in module 23 may be configured to transmit the initialization voltage signal Vin to the initialization module 22, and the initialization module 22 may initialize the control end and the first end of the driving module 24 to the same voltage level.

More specifically, the first stage T11 may be an initialization stage. In the first stage T11, because the first transistor M1 and the second transistor M2 in the pixel driving circuit 200 are turned on, the initialization voltage signal Vin inputted by the data signal end VDATA may be transmitted to the nodes N1 and N2. By then, the voltage levels at the nodes N1 and N2 may be equal to Vin. Because the voltage level of the initialization voltage signal Vin is relatively small, the voltage difference between the voltage level of the signal outputted by the first voltage end PVDD and the voltage level of the initialization voltage signal Vin may be smaller than the turn-on voltage of the organic light-emitting element D1. Accordingly, the organic light-emitting element D1 may not emit light.

In the second stage T12, the first voltage level signal may be supplied to the second scanning signal end Scan2 and the light-emitting end Emit, thereby turning on the second transistor M2 and the third transistor M3. The second voltage level signal may be supplied to the first scanning signal end Scan1, thereby turning off the first transistor M1. Further, a first signal Vbis may be supplied to the data signal end VDATA, and the data write-in module 23 may write the first signal Vbis to the control end of the driving module 21. The first voltage end PVDD may charge the first electrode of the driving module 21.

More specifically, the second stage T12 may be a threshold detection stage. In the second stage T12, because the first transistor M1 is turned off and the second transistor M2 in the pixel driving circuit 200 is turned on, the signal Vbis inputted by the data signal end VDATA may be transmitted to the first node N1. Further, the voltage level of the initialization voltage signal Vin may be configured to be lower than the voltage level of the first signal Vbis. That is, Vbis>Vin.

Further, the difference in the voltage level between the first signal Vbis and the initialization voltage signal Vin may be configured to be greater than the threshold voltage Vth of the driving transistor DT (i.e., Vbis−Vin>Vth). Accordingly, the driving transistor DT may be turned on. Because the driving transistor DT and the third transistor M3 are turned on, the first voltage end PVDD may charge the node N2 via the third transistor M3, thereby raising the voltage level of the second node N2.

When the voltage level of the second node N2 is raised to Vbis-Vth, the driving transistor DT may be turned off, and the first voltage end PVDD may stop charging the second node N2. By then, the voltage level of the first node N1 may be equal to Vbis, and the voltage level of the second node N2 may be equal to Vbis-Vth. That is, the difference in the voltage level between two plates of the first capacitor C1 may be equal to Vth, and the first capacitor C1 may be configured to store the threshold voltage Vth of the driving transistor DT.

Further, the difference between the voltage level at the node N2 and the voltage level of the second voltage end PVEE may be configured to be smaller than the turn-on voltage Voled of the organic light-emitting element D1. Thus, the organic light-emitting element D1 may not emit light in the second stage T12.

In the third stage T13, the first voltage level signal may be supplied to the second scanning signal end Scan2, thereby turning on the second transistor M2. The second voltage level signal may be supplied to the first scanning signal end Scan1 and the light-emitting signal end Emit, thereby turning off the first transistor M1 and the third transistor M3. Further, the data signal Vdata may be supplied to the data signal end VDATA, and the data write-in module 23 may be configured to write the data signal Vdata to the gate electrode of the driving transistor DT. That is, the signal received by the gate electrode of the driving transistor may change from the aforementioned first signal Vbis to the data signal Vdata.

More specifically, the third stage T13 may be a data write-in stage. Because the second transistor M2 is turned on, the data signal Vdata may be transmitted to the first node N1. Thus, when changing from the second stage T12 to the third stage T13, the variance in the voltage level of an end (the first node N1) of the first capacitor C1 may be Vdata-Vbis, and the other end (the node N2) of the first capacitor C1 may be floated.

Accordingly, subject to the coupling effect of the first capacitor C1 and the voltage divider effect of the second capacitor C2 and the organic light-emitting element D1, the variance in the voltage level at the second node N2 may be equal to (C01/(C01+C02+Coled))×(Vdata−Vbis). That is, in the third stage, the voltage level at the node N2 may change into Vbis−Vth+(C01/(C01+C02+Coled))×(Vdata−Vbis), where C01, C02, Coled represent the capacitance value of the first capacitor C1, the second capacitor C2, and the organic light-emitting element D1. Optionally, Vdata-Vbis>0.

In the fourth stage T14, the first voltage level signal may be supplied to the light-emitting signal end Emit, thereby turning on the third transistor M3. The second voltage level signal may be supplied to the first scanning signal end Scan1 and the second scanning signal end Scan2, thereby turning off the first transistor M1 and the second transistor M2. The organic light-emitting element D1 may emit light based on the voltage level difference between the voltage level of the first electrode of the driving transistor DT and the voltage level of the control end of the driving transistor DT.

More specifically, the fourth stage T14 may be a light-emitting stage. In the fourth stage T14, the third transistor M3 may be turned on, and the driving transistor DT may be turned on to the drive the organic light-emitting element D1 to emit light. Further, the light-emitting current Ids may be expressed using equation (1) shown as follows.

$$\begin{aligned} Ids &= K(Vgs - |Vth|)^2 \\ &= K\left[Vdata - Vbis + Vth - \frac{C01}{C01 + C02 + Coled}\square(Vdata - Vbis) - Vth\right] \\ &= K\left[Vdata - Vbis - \frac{C01}{C01 + C02 + Coled}\square(Vdata - Vbis)\right]^2 \end{aligned} \quad (1)$$

In particular, K is a coefficient related to the channel width-to-length ratio of the driving transistor DT, and Vgs represents the difference in the voltage level between the control end and the first electrode of the driving transistor DT. Further, the voltage difference between the control end and the first electrode of the driving transistor DT may be the voltage difference between the node N1 and the node N2.

Referring to the aforementioned expression of the voltage difference Vgs (i.e., Vgs=A+Vth) between the control end and the first electrode of the driving transistor DT in the pixel driving circuit shown in FIG. 2, the parameter A may be equal to Vdata-Vbis-(C01/(C01+C02+Coled))×(Vdata-Vbis). That is, the parameter A may be unrelated to Vth, but related to the signal Vbis and Vdata inputted by the data signal end VDATA.

As shown in equation (1), the light-emitting current Ids of the organic light-emitting element D1 may be unrelated to the threshold voltage Vth of the driving transistor DT. Accordingly, the pixel driving circuit 200 in FIG. 2 may implement the compensation in the threshold voltage Vth of the driving transistor DT. Further, the circuit structure may be relatively simple, and the number of signal lines may be relatively small, thereby facilitating the design of high resolution display panels.

Further, referring to FIG. 9, an operational timing sequence is provided for a pixel driving circuit 400 in FIG. 4. The operational timing sequence in FIG. 9 may include a first stage T21, a second stage T22, a third stage T23, and a fourth stage T24. In the first stage T21, the first voltage level signal may be supplied to the first scanning signal end Scan1 and the light-emitting signal end Emit, thereby turning on the first transistor M1, the third transistor M3, and the fourth transistor M4. The second voltage level signal may be supplied to the second scanning signal end Scan2, thereby turning off the second transistor M2.

Further, a first signal Vbis may be supplied to the data signal end VDATA, and a reference voltage signal Vref may be supplied to the reference voltage signal end VREF. Because the first transistor M1 and the fourth transistor M4 are turned on, the reference voltage signal Vref may be transmitted to the control end (the first node N1) and the first electrode (the second node N2) of the driving transistor DT.

By then, the voltage levels at the first node N1 and the second node N2 may be equal to Vref. Further, because the voltage level of the reference voltage signal Vref is lower than the turn-on voltage Voled of die organic light-emitting element D1, the organic light-emitting element D1 may not emit light.

In the second stage T22, the first voltage level signal may be supplied to the second scanning signal end Scan2 and the light-emitting end Emit, thereby turning on the second transistor M2 and the third transistor M3. The second voltage level signal may be supplied to the first scanning signal end Scan1, thereby turning off the first transistor M1 and the fourth transistor M4.

Further, the first signal Vbis may be supplied to the data signal end VDATA. Because the second transistor M2 is turned on, the first signal Vbis may be transmitted to the first node 1. Further, because Vbis>Vref, the voltage level at the first node N1 may be indicated to be raised, such that the driving transistor DT may be turned on.

Further, because the third transistor T3 is turned on, the first voltage end PVDD may charge the second node N2 and raise the voltage level of the second node N2. When the voltage level of the second node N2 is equal to Vbis-Vth, the driving transistor DT may be turned off, and the first voltage end PVDD may stop charging.

By then, the voltage level at the first node N1 may be equal to Vbis, and the voltage level at the second node N2 may be equal to Vbis-Vth. Further, the first capacitor C1 may be configured to store the threshold voltage Vth of the driving transistor DT.

In the third stage T23, the first voltage level signal may be supplied to the second scanning signal end Scan2, thereby turning on the second transistor M2. The second voltage level signal may be supplied to the first scanning signal end Scan1 and the light-emitting signal end Emit, thereby turning off the first transistor M1, the third transistor M3, and the fourth transistor M4. Further, the data signal Vdata may be supplied to the data signal end VDATA, and because the second transistor M2 is turned on, the data signal Vdata may be written into the first node N1.

By then, the voltage level at the first node N1 may be raised from Vbis to Vdata. Under the coupling effect of the first capacitor C1, the variance in the voltage level at the second node N2 may be equal to (C01/(C01+C02+Coled))×(Vdata-Vbis). That is, the voltage level at the second node N2 may be changed to Vbis-Vth+(C01/(C01+C02+Coled))×(Vdata-Vbis).

Further, the fourth stage T24 may refer to a light-emitting stage, the working principles of the fourth stage T24 in FIG. 9 may be the same as the fourth stage T14 illustrated in FIG. 8. The light-emitting current Ids of the organic light-emitting element D1 may still be calculated using the equation (1).

As shown in FIG. 9, by using the pixel driving circuit 400 shown in FIG. 4, the signal outputted by the data signal end VDATA may only change once from Vbis to Vdata when driving the pixel driving circuit 400. That is, different from the timing sequence shown in FIG. 8 that drives the pixel driving circuit 200 in FIG. 2, the number of transitions in the voltage level of the data signal end VDATA in the timing sequence shown in FIG. 9 may be effectively reduced. Accordingly, the complexity of the driving method may be reduced, thereby enhancing the stability of the signal transmitted by the data signal line that is connected to the data signal end.

Further, referring to FIG. 10, an operational timing sequence may be provided for driving a pixel driving circuit 600 in FIG. 6. The operational timing sequence in FIG. 10 may include a first stage T31, a second stage T32, a third stage T33, and a fourth stage T34. In the first stage T31, the first voltage level signal may be supplied to the first scanning signal end Scan1 and the light-emitting signal end Emit, thereby turning on the first transistor M1 and the third transistor M3. The second voltage level signal may be supplied to the second scanning signal end Scan2, thereby turning off the second transistor M2.

Further, the second voltage level signal may be supplied to the third scanning signal end Scan3, thereby turning-off the fifth transistor M5. Because the first transistor M1 is turned on, the first node N1 and the second node N2 may be initialized to the same voltage level.

In the second stage T32, the first voltage level signal may be supplied to the second scanning signal end Scan2 and the light-emitting end Emit, thereby turning on the second transistor M2 and the third transistor M3. The second voltage level signal may be supplied to the first scanning signal end Scan1 and the third scanning signal end Scan3, thereby turning off the first transistor M1 and the fifth transistor M5. Further, a first signal Vdata may be supplied to the data signal end VDATA, and because the second transistor M2 is turned on, the first signal Vdata may be transmitted to the first node N1.

By then, the voltage level at the first node N1 may be higher than the voltage level at the second node N2, thereby turning on the driving transistor DT. Further, because the third transistor M3 and the driving transistor DT are both turned on, the first voltage end PVDD may charge the second node N2 (i.e., the first electrode of the driving transistor DT) to raise the voltage level of the second node N2.

When the voltage level at the second node N2 is raised to Vdata-Vth, the driving transistor D1 may be turned off, and the first voltage end PVDD may stop charging. By then, the voltage level at the first node N1 may be equal to Vdata, and the voltage level at the second node N2 may be equal to Vdata-Vth.

In the third stage T33, the second voltage level signal may be supplied to the first scanning signal end Scan1, the second scanning signal end Scan2, and the light-emitting signal end Emit, thereby turning off the first transistor M1, the second transistor M2, and the third transistor M3. The first voltage level signal may be supplied to the third scanning signal end Scan3, thereby turning on the fifth transistor M5.

Further, a data signal Vdata may be supplied to the data signal end VDATA, and the data signal Vdata in the third stage T33 may be equal to the first signal Vdata supplied to the data signal end VDATA in the second stage T32. Because the fifth transistor M5 is turned on, the first voltage end PVDD may charge the gate electrode (the first node N1) of the driving transistor DT, thereby raising the voltage level at the first node N1 to be equal to a voltage level of a signal VDD1 outputted by the first voltage end PVDD. During such a period, the voltage level at the first node N1 may change from the voltage level of the first signal Vdata to the voltage level of the signal VDD1 outputted by the first voltage end PVDD.

Accordingly, under the coupling effect of the first capacitor C1, the variance in the voltage level of the second node N2 may be equal to (C01/(C01+C02+Coled))×(VDD1−Vdata). That is, the voltage level at the node N2 may change into Vdata-Vth+(C01/(C01+C02+Coled))×(VDD1−Vdata).

In the fourth stage T34, the first voltage level signal may be supplied to the light-emitting signal end Emit, and the second voltage level signal may be supplied to the first scanning signal end Scan1, the second scanning signal end Scan2, and the third scanning signal end Scan3. Thus, the third transistor M3 and the driving transistor DT may be turned on, and the first transistor M1, the second transistor M2, and the fifth transistor M5 may be turned off.

Because the third transistor M3 and the driving transistor DT are turned on in the fourth stage T34, and the organic light-emitting element D1 may emit light based on the voltage level difference Vgs between the first electrode (the second node N2) of the driving transistor DT and the control end (the first node N1) of the driving transistor DT. More specifically, the light-emitting current Ids' may be expressed using equation (2) shown as follows.

$$\begin{aligned} Ids' &= K(Vgs - |Vth|)^2 \\ &= K\left[VDD1 - Vdata + Vth - \frac{C01}{C01 + C02 + Coled}\square(VDD1 - Vdata) - Vth\right] \\ &= K\left[VDD1 - Vdata - \frac{C01}{C01 + C02 + Coled}\square(VDD1 - Vdata\right]^2 \end{aligned} \quad (2)$$

In particular, K is a coefficient related to the channel width-to-length ratio of the driving transistor DT. Referring to the aforementioned expression of the voltage difference Vgs (i.e., Vgs=A+Vth) between the control end and the first electrode of the driving transistor DT in the pixel driving circuit shown in FIG. 2, the parameter A may be equal to VDD1−Vdata−(C01/(C01+C02+Coled))×(VDD1−Vdata). That is, A may be unrelated to the threshold voltage Vth of the driving transistor DT, but related to the signal Vdata inputted by the data signal end VDATA and the signal VDD1 inputted by the first voltage end PVDD.

As shown in equation (2), the light-emitting current Ids of the organic light-emitting element D1 may be unrelated to the threshold voltage Vth of the driving transistor DT. Accordingly, the pixel driving circuit 600 illustrated in FIG. 6 may also implement the compensation of the threshold voltage of the driving transistor DT.

Further, referring to FIG. 10, the signal SC1 outputted by the first scanning signal end Scan1, the signal SC2 outputted by the second scanning signal end Scan2, and the signal SC3 outputted by the third scanning signal end Scan3 may all be a single pulse signal. For the same pixel driving circuit 600, the signal outputted by the second scanning signal end Scan2 and the signal outputted by the third scanning signal end Scan3 may each correspond to the signal outputted by the first scanning signal end Scan1 after being delayed by one pulse with and two pulse widths, respectively.

Accordingly, when the disclosed driving method is applied to drive the organic light-emitting display panel, two adjacent rows of pixel driving circuits may share one or two scanning signal lines. For example, in the disclosed organic light-emitting display panel 700, a plurality of second scanning signal ends Scan2 in a row of pixel driving circuits 600 and a plurality of first scanning signal ends Scan1 in an adjacent row of pixel driving circuits 600 may be connected to a same first scanning signal line or a same second scanning signal line.

Further, a plurality of third scanning signal ends Scan3 in a row of pixel driving circuits 600 and a plurality of second scanning signal ends Scan3 in an adjacent row of pixel driving circuits 600 may be connected to the same second scanning signal line or the same third scanning signal line. As such, the organic light-emitting display panel including the pixel driving circuit 600 illustrated in FIG. 6 not only implement the threshold voltage compensation of the driving transistor, but also reduce the number of signal lines, thereby facilitating the design of high resolution display panels.

Further, the data signal end VDATA in each pixel driving circuit 600 of the organic light-emitting display panel may supply a stable data signal when each row of pixel driving circuits 600 is under operation. Accordingly, the stability of the signal transmitted by the data signal line may be improved, and the impact of the signal carried by the data signal line being instable on the display effort may be avoided.

Further, the disclosed driving method may further include supplying a first voltage signal to the first voltage end PVDD and supplying a second voltage signal to the second voltage end PVEE throughout the first, second, third and fourth stages. The first voltage signal and the second voltage signal may be both signals with a fixed voltage level.

Further, the voltage level of the first voltage signal may be greater than the voltage level of the second voltage signal. The first voltage signal end in each pixel driving circuit of the organic light-emitting display panel may be connected to the same first voltage signal line, and the second voltage signal end in each pixel driving circuit may be connected to the same second voltage signal line.

Figure 11:
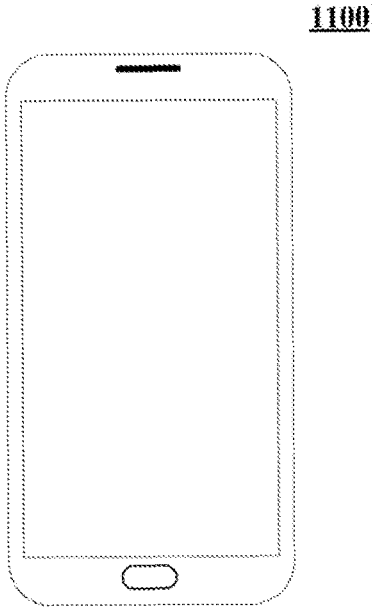
FIG. 11 illustrates an exemplary display device according to embodiments of the present disclosure.

FIG. 11 illustrates an exemplary display device 1100 according to embodiments of the present disclosure. As shown in FIG. 11, the organic light-emitting display device 1100 may be a cell phone. Further, the organic light-emitting display device 1100 may include an organic light-emitting display panel as disclosed above. Optionally, the organic light-emitting display device 1100 may be a tablet, a wearable apparatus, or other devices including the disclosed organic light-emitting display panel. Further, the organic light-emitting display device 1100 may include an encapsulation film, and a protecting glass, etc.

It should be noted that, the above detailed descriptions illustrate only preferred embodiments of the present disclosure and technologies and principles applied herein. Those skilled in the art can understand that the present disclosure is not limited to the specific embodiments described herein, and numerous significant alterations, modifications and alternatives may be devised by those skilled in the art without departing from the scope of the present disclosure. Thus, although the present disclosure has been illustrated in above-described embodiments in details, the present disclosure is not limited to the above embodiments. Any equivalent or modification thereof, without departing from the spirit and principle of the present invention, falls within the true scope of the present invention, and the scope of the present disclosure is defined by the appended claims.

What is claimed is:

1. An organic light-emitting display panel, comprising:

a plurality of pixel driving circuits, wherein a pixel driving circuit of the plurality of pixel driving circuits includes an organic light-emitting element, a driving module, an initialization module at least including a first transistor, a data write-in module including a second transistor, and a light-emitting control module at least including a third transistor, wherein:

the driving module includes a control end, a first end and a second end, the light-emitting control module, at least including the third transistor, is configured to transmit a signal to the second end of the driving module, the driving module includes a driving transistor and is configured to drive the organic light-emitting element to emit light based on the signal transmitted by the light-emitting control module, the initialization module, at least including the first transistor, is configured to initialize a voltage level of the control end and a voltage level of the first end of the driving module, the data write-in module, including the second transistor, is configured to write a data signal into the control end of the driving module, the pixel driving circuit further includes a fourth transistor included in the initialization module or a fifth transistor included in the light-emitting control module, a first electrode of the fourth transistor is electrically connected to a reference voltage signal end, and a first electrode of the fifth transistor is electrically connected to a first voltage end.

2. The organic light-emitting display panel according to claim 1, wherein:

the signal transmitted by the light-emitting control module to the second end of the driving module is outputted by the first voltage end, the light-emitting element accesses a signal outputted by a second voltage end, the driving module is under control of the control end, the light-emitting control module is under control of a light-emitting signal end, the initialization module is under control of a first scanning signal end, the data write-in module is under control of a second scanning signal end, and the data signal written by the data write-in module into the control end of the driving module is outputted by a data signal end.

3. The organic light-emitting display panel according to claim 2, wherein:

the driving module further includes a first capacitor, and the light-emitting control module further includes a second capacitor.

4. The organic light-emitting display panel according to claim 3, wherein:

two plates of the first capacitor are electrically connected to a control end and a first electrode of the driving transistor, respectively, the first electrode of the driving transistor is electrically connected to a first electrode of the light-emitting element, a first electrode of the first transistor is electrically connected to the control end of the driving transistor, a second electrode of the first transistor is electrically connected to the first electrode of the driving transistor, and a gate electrode of the first transistor is electrically connected to the first scanning signal end, a gate electrode of the second transistor is electrically connected to the second scanning signal end, a first electrode of the second transistor is electrically connected to the data signal end, and a second electrode of the second transistor is electrically connected to the control end of the driving transistor, a gate electrode of the third transistor is electrically connected to the light-emitting signal end, a first electrode of the third transistor is electrically connected to the first voltage end, and a second electrode of the third transistor is electrically connected to a second electrode of the driving transistor, and two plates of the second capacitor are electrically connected to the first and second electrodes of the driving transistor, respectively.

5. The organic light-emitting display panel according to claim 2, further comprising the plurality of pixel driving circuits arranged in an array, a plurality of first scanning signal lines, a plurality of second scanning signal lines, a plurality of light-emitting signal lines, a plurality of data lines, a first voltage signal line, and a second voltage signal line, wherein:

a first scanning signal line is electrically connected to a plurality of first scanning signal ends in a row of pixel driving circuits of the plurality of pixel driving units, a second scanning signal line is electrically connected to a plurality of second scanning signal ends in the row of the pixel driving circuits of the plurality of pixel driving units, a light-emitting signal line is electrically connected to a plurality of light-emitting signal ends in the row of the pixel driving circuits of the plurality of pixel driving units, a data line is electrically connected to a plurality of data signal ends in a column of pixel driving circuits of the plurality of pixel driving units, a first voltage end of the pixel driving circuit of the plurality of pixel driving units is electrically connected to the first voltage signal line, and a second voltage end of the pixel driving circuit of the plurality of pixel driving units is electrically connected to the second voltage signal line.

6. The organic light-emitting display panel according to claim 5, wherein:

a gate electrode of the fourth transistor is electrically connected to the first scanning signal end, and a second electrode of the fourth transistor is electrically connected to the first electrode of the driving transistor.

7. The organic light-emitting display panel according to claim 6, further comprising at least one reference voltage signal line, wherein:

each of the at least one reference voltage signal line is electrically connected to reference voltage signal ends of at least two of pixel driving circuits of the plurality of pixel driving units.

8. The organic light-emitting display panel according to claim 5, wherein:

the pixel driving circuit of the plurality of pixel driving units further includes a third scanning signal end, a gate electrode of the fifth transistor is electrically connected to the third scanning signal end, and a second electrode of the fifth transistor is electrically connected to the control end of the driving transistor.

9. The organic light-emitting display panel according to claim 8, further comprising a plurality of third scanning signal lines, wherein:

a third scanning signal line is electrically connected to a plurality of third scanning signal ends in the row of the pixel driving circuits of the plurality of pixel driving units.

10. The organic light-emitting display panel according to claim 9, wherein:

a plurality of second scanning signal ends in an $(m-1)^{th}$ row of pixel driving circuits of the plurality of pixel driving units and a plurality of first scanning signal ends in an $m^{th}$ row of pixel driving circuits of the plurality of pixel driving units are connected to a same first scanning signal line, and a plurality of third scanning signal ends in the $(m-1)^{th}$ row of pixel driving circuits and a plurality of second scanning signal ends in the $m^{th}$ row of pixel driving circuits are connected to a same second scanning signal line, where m is a positive integer greater than 1.

11. A driving method of an organic light-emitting display panel, wherein the organic light-emitting display panel includes a pixel driving circuit comprising a driving transistor, an initialization module connected to a first scanning signal end, a data write-in module connected to a second scanning signal end and a data signal end, a light-emitting control module connected to a light-emitting signal end and a first voltage end, the driving method comprising:

in a first stage, supplying a first voltage level signal to the first scanning signal end and the light-emitting signal end, thereby initializing, by the initialization module, a control end and a first end of the driving module to a same voltage level;

in a second stage, supplying the first voltage level signal to the second scanning signal end and the light-emitting signal end, supplying a second voltage level signal to the first scanning signal end, and supplying a first signal to the data signal end, thereby writing the first signal, by the data write-in module to the control end of the driving module, and charging, by the first voltage end, the first end of the driving module;

in a third stage, supplying the second voltage level signal to the light-emitting signal end, and supplying a data signal to the data signal end, thereby raising or lowing the voltage level of the control end of the driving module; and in a fourth stage, supplying the first voltage level signal to the light-emitting signal end and supplying the second voltage level signal to the first scanning signal end and the second scanning signal end, such that an organic light-emitting element emits light based on a voltage difference between the first end and the control end of the driving module.

12. The driving method according to claim 11, wherein the driving module includes a driving transistor and a first capacitor, the initialization module includes a first transistor under control of the first scanning signal end, the data write-in module includes a second transistor under control of the second scanning signal end, the light-emitting control module includes a third transistor and a second capacitor, a first electrode of the driving transistor is connected to a first electrode of the organic light-emitting element, a first plate of the first capacitor, a first plate of the second capacitor, and a first electrode of the first transistor, a second electrode of the driving transistor is connected to a second plate of the second capacitor and a second electrode of the third transistor, a control end of the driving transistor is connected to a second plate of the first capacitor, a second electrode of the first transistor, and a second electrode of the second transistor, a first electrode of the second transistor is connected to the data signal end, a first electrode of the third transistor is connected to the first voltage end, and a gate electrode of the third transistor is connected to the light-emitting signal end, the method further comprising:

in the first stage, initializing the control end and the first electrode of the driving transistor to the same voltage level, in the second stage, writing the first signal to the control end of the driving transistor, charging the first electrode of the driving transistor, and storing, by the first capacitor, a threshold voltage of the driving transistor, in the third stage, changing the voltage level of the control end of the driving transistor, and in the fourth stage, emitting light, by the organic light-emitting element, based on the voltage level difference between the first electrode and the control end of the driving transistor.

13. The driving method according to claim 12, further comprising:

in the first stage, supplying the first voltage level signal to the second scanning signal end, supplying an initialization voltage signal to the data signal end, thereby transmitting, by the data write-in module, an initialization voltage signal to the initialization module; and in the third stage, supplying the first voltage level signal to the second scanning signal end, thereby writing the data signal, by the data write-in module, to the gate electrode of the driving transistor, and changing a signal at the gate electrode of the driving transistor from the first signal to the data signal.

14. The driving method according to claim 13, wherein:

the pixel driving circuit further includes a second voltage end, a voltage level of the initialization voltage signal is lower than a voltage level of the first signal, and a difference in voltage level between the initialization voltage signal and a signal outputted by the second voltage end is smaller than a turn-on voltage of the organic light-emitting element.

15. The driving method according to claim 12, wherein the pixel driving circuit further includes a fourth transistor, a gate electrode of the fourth transistor is connected to the first scanning signal line, a first electrode of the fourth transistor is connected to a reference voltage signal end, and a second electrode of the fourth transistor is connected to the first electrode of the driving transistor, the method further comprising:

in the first stage, supplying the second voltage level signal to the second scanning signal end, supplying a first signal to the data signal end, and supplying a reference voltage signal to the reference voltage signal end, thereby transmitting the reference voltage signal, by the initialization module, to the control end and the first electrode of the driving transistor; and in the third stage, supplying the first voltage level signal to the second scanning signal end, thereby writing the data signal, by the data write-in module, into the control end of the driving transistor, wherein a voltage level of the reference voltage signal is lower than the turn-on voltage of the organic light-emitting element.

16. The driving method according to claim 12, wherein:

a voltage level of the first signal is lower than the voltage level of the data signal.

17. The driving method according to claim 12, wherein the pixel driving circuit further includes a fifth transistor, a gate electrode of the fifth transistor is connected to a third scanning signal line, a first electrode of the fifth transistor is connected to the first voltage end, and a second electrode of the fifth transistor is connected to the control end of the driving transistor, the method further comprising:

in the first stage, supplying the second voltage level signal to the second scanning signal end, in the first stage, the second stage and the fourth stage, supplying the second voltage level signal to the third scanning signal end, and in the third stage, supplying the first voltage level signal to the third scanning signal end, charging the control end of the driving transistor, and changing the signal of the control end of the driving transistor from the first signal to the signal inputted by the first voltage end.

18. The driving method according to claim 12, further comprising:

in the first to the fourth stage, supplying the first voltage signal to the first voltage end, and supplying the second voltage signal to the second voltage end, wherein the voltage of the first voltage signal is greater than the voltage of the second voltage signal.

19. An organic light-emitting display device, comprising:

an organic light-emitting display panel comprising a pixel driving circuit, wherein:

the pixel driving circuit comprises an organic light-emitting element, a driving module, an initialization module at least including a first transistor, a data write-in module including a second transistor, and a light-emitting control module at least including a third transistor, wherein:

the driving module includes a control end, a first end and a second end, the light-emitting control module, at least including the third transistor, is configured to transmit a signal to the second end of the driving module, the driving module includes a driving transistor and is configured to drive the organic light-emitting element to emit light based on the signal transmitted by the light-emitting control module, the initialization module, at least including the first transistor, is configured to initialize a voltage level of the control end and a voltage level of the first end of the driving module, the data write-in module, including the second transistor, is configured to write a data signal into the control end of the driving module, the pixel driving circuit further includes a fourth transistor included in the initialization module or a fifth transistor included in the light-emitting control module, a first electrode of the fourth transistor is electrically connected to a reference voltage signal end, and a first electrode of the fifth transistor is electrically connected to a first voltage end.

20. The organic light-emitting display device according to claim 19, wherein:

the signal transmitted by the light-emitting control module to the second end of the driving module is outputted by the first voltage end, the light-emitting element accesses a signal outputted by a second voltage end, the driving module is under control of the control end, the light-emitting control module is under control of a light-emitting signal end, the initialization module is under control of a first scanning signal end, the data write-in module is under control of a second scanning signal end, and the data signal written by the data write-in module into the control end of the driving module is outputted by a data signal end.

* * * * *